US008040312B2

(12) United States Patent
Chen et al.

(10) Patent No.: US 8,040,312 B2
(45) Date of Patent: Oct. 18, 2011

(54) CHIP-ON-GLASS LIQUID CRYSTAL DISPLAY AND DATA TRANSMISSION METHOD FOR THE SAME

(75) Inventors: Chien-Ru Chen, Hsinhua (TW); Jung-Zone Chen, Hsinhua (TW); Ying-Lieh Chen, Hsinhua (TW)

(73) Assignee: Himax Technologies Limited, Taiwan (CN)

( * ) Notice: Subject to any disclaimer, the term of this patent is extended or adjusted under 35 U.S.C. 154(b) by 1188 days.

(21) Appl. No.: 11/371,925

(22) Filed: Mar. 10, 2006

(65) Prior Publication Data

US 2006/0202936 A1 Sep. 14, 2006

(30) Foreign Application Priority Data

Mar. 11, 2005 (TW) ..... 94107567 A

(51) Int. Cl.
*G09G 3/36* (2006.01)

(52) U.S. Cl. ..... 345/100; 345/99

(58) Field of Classification Search ..... 345/100, 345/55–56, 93–96, 99, 103; 315/167–169.3; 348/488–490

See application file for complete search history.

(56) References Cited

U.S. PATENT DOCUMENTS

| | | | | |
|---|---|---|---|---|
| 5,420,482 | A | 5/1995 | Phares | |
| 5,726,677 | A * | 3/1998 | Imamura | 345/99 |
| 5,990,802 | A | 11/1999 | Maskeny | |
| 6,388,651 | B1 | 5/2002 | Kinoshita et al. | |
| 6,459,417 | B1 * | 10/2002 | Orisaka et al. | 345/98 |
| 6,657,622 | B2 * | 12/2003 | Park | 345/205 |
| 2001/0033278 | A1 * | 10/2001 | Ohta et al. | 345/204 |
| 2002/0060661 | A1 * | 5/2002 | Nah et al. | 345/99 |
| 2003/0090614 | A1 | 5/2003 | Kim et al. | |
| 2005/0078459 | A1 * | 4/2005 | Yeon | 361/749 |
| 2005/0152189 | A1 * | 7/2005 | Kim et al. | 365/185.29 |

FOREIGN PATENT DOCUMENTS

| | | | |
|---|---|---|---|
| EP | 1220018 | | 7/2002 |
| EP | 1594112 | | 11/2005 |
| JP | 09-050264 | A | 2/1997 |
| JP | 11-194713 | | 7/1999 |
| JP | 2003-167560 | A | 6/2003 |
| JP | 2004-145340 | A | 5/2004 |
| JP | 2004-205901 | | 7/2004 |
| TW | 583637 | | 3/1992 |
| WO | WO 03/060862 | | 7/2003 |

* cited by examiner

*Primary Examiner* — Sumati Lefkowitz
*Assistant Examiner* — Jonathan Horner
(74) *Attorney, Agent, or Firm* — McDermott Will & Emery LLP

(57) ABSTRACT

A display implemented with a unique circuit arrangement. The display includes a glass substrate, a plurality of serial-connected source drivers and at least one gate driver. The source drivers and the at least one gate driver are disposed on the glass substrate using, for example, chip-on-glass technology. The display further includes at least one flexible connector, such as a flexible printed circuit board. Each of the at least one flexible connector corresponds to a selected one of the source drivers. The selected one of the source drivers is configured to receive image data and control information from the corresponded flexible connector, and convey the image data and the control information to at least one neighboring source driver.

18 Claims, 10 Drawing Sheets

CHIP-ON-GLASS LIQUID CRYSTAL DISPLAY AND DATA TRANSMISSION METHOD FOR THE SAME

RELATED APPLICATION

This application claims the benefit of Taiwanese patent application serial No. 94107567, filed Mar. 11, 2005, the disclosure of which is incorporated herein by reference in its entirety.

FIELD OF THE INVENTION

The disclosure relates in general to liquid crystal displays, and more particularly, to chip-on-glass liquid crystal displays with unique circuit arrangement to reduce fabrication complexity and improve signal quality.

BACKGROUND OF THE DISCLOSURE

Liquid crystal displays (LCD) have become more and more popular for use in computer monitors or TVs due to light weight, flatness and low radiation. In addition to improving the display quality of LCDs, such as color, contrast and brightness, LCD manufacturers try to improve the manufacturing process to reduce cost and manufacturing time.

Generally, an LCD includes a timing controller, source drivers and at least one gate driver to drive its liquid crystal panel. in a conventional LCD, the timing controller is welded on a control print circuit board, the source drivers are welded on an X-board, and the gate driver is welded on a Y-board. The control print circuit board connects to the X-board via flexible printed circuit boards (FPCs), while the X-board and the Y board each connects to the liquid crystal panel via other FPCs. Therefore, the conventional LCD requires at least three boards connecting to the panel and hence the manufacturing process is complex. In order to simplify the manufacturing process, chip-on-glass (COG) LCDs are developed.

FIG. 1 is diagram of a conventional COG LCD. The COG LCD 100 includes a panel 110, a plurality of source drivers 112, at least one gate driver 114, a printed circuit board 120 and a plurality of flexible printed circuit boards 130. The source drivers 112 and the gate driver 114 are disposed on the glass substrate of the panel 110 and electrically connect to the printed circuit board 120 via the flexible printed circuit boards 130. The timing controller (not shown in FIG. 1) is disposed on the printed circuit board 120, outputting image data and control signals to the source drivers 112 and the gate driver 114. In COG LCD 100, only one board (PCB 120), instead of three, is required to connect to the panel 110 via the FPCs 130. Therefore, the manufacturing process is simplified comparing to that of conventional LCDs not implemented using chip-on-glass technology.

However, the manufacturing process of conventional COG LCDs is still complex because it still needs many flexible printed circuit boards. As shown in FIG. 1, the number of flexible printed circuit board in a conventional COG LCD is 11. In addition, the large number of flexible printed boards in a conventional COG LCD needs a plurality of contact points to connect to the liquid crystal panel. Therefore, the possibility of electrical contact failure increases with the number of contact points.

Accordingly, there is a need for a COG LCD that further reduces the needed number of flexible printed circuit boards.

SUMMARY OF THE DISCLOSURE

This disclosure proposes display devices with unique circuit arrangements that reduce the needed number of connecting points connecting circuits disposed on a glass substrate of the display devices and other circuits not disposed on the glass substrate. The display devices may be liquid crystal displays (LCDs) or other types of displays that use driving circuits, such as source drivers and/or gate drivers, for controlling the display of images.

An exemplary display includes a glass substrate, a plurality of serial-connected source drivers and at least one gate driver. The source drivers and the at least one gate driver are disposed on the glass substrate using, for example, chip-on-glass technology. The display further includes at least one flexible connector, such as a printed circuit board. Each of the at least one flexible connector corresponds to a selected one of the source drivers. The selected one of the source drivers is configured to receive image data and control information from the corresponded flexible connector, and convey the image data and the control information to at least one neighboring source driver. In one aspect, the at least one flexible connector is disposed in such a way that delays and distortions of the image data and the control information are acceptable to the source drivers.

According to one embodiment, the image data and control information are provided by a control circuit, such as timing controllers, not disposed on the glass substrate. The control circuit may be disposed on a circuit board coupling to the display via the at least one flexible connector.

An exemplary source driver according to this disclosure includes a first receiver and a second receiver, both configured to receive image data and control information, and a first transceiver and a second transceiver, both coupled to at least one neighboring source driver. A driving unit is provided to generate driving voltages based on the image data and the control information to drive the display. A bus switch selectively couples the first transceiver and the second transceiver. When the source driver is set to operate in a dual-way transmission mode, the first transceiver and the second transceiver are disconnected. The first transceiver receives the image data and the control information from the first receiver, and the second transceiver receives the image data and the control information form the second receiver. When the source driver is set to operate in a single-way transmission mode, the first transceiver and the second transceiver are connected. The image data and the control information received by the first transceiver are transmitted to the second transceiver.

Other objects, features, and advantages of the disclosure will become apparent from the following detailed description of the preferred but non-limiting embodiments. The following description is made with reference to the accompanying drawings.

DETAILED DESCRIPTION OF THE DISCLOSURE

Figure 1:
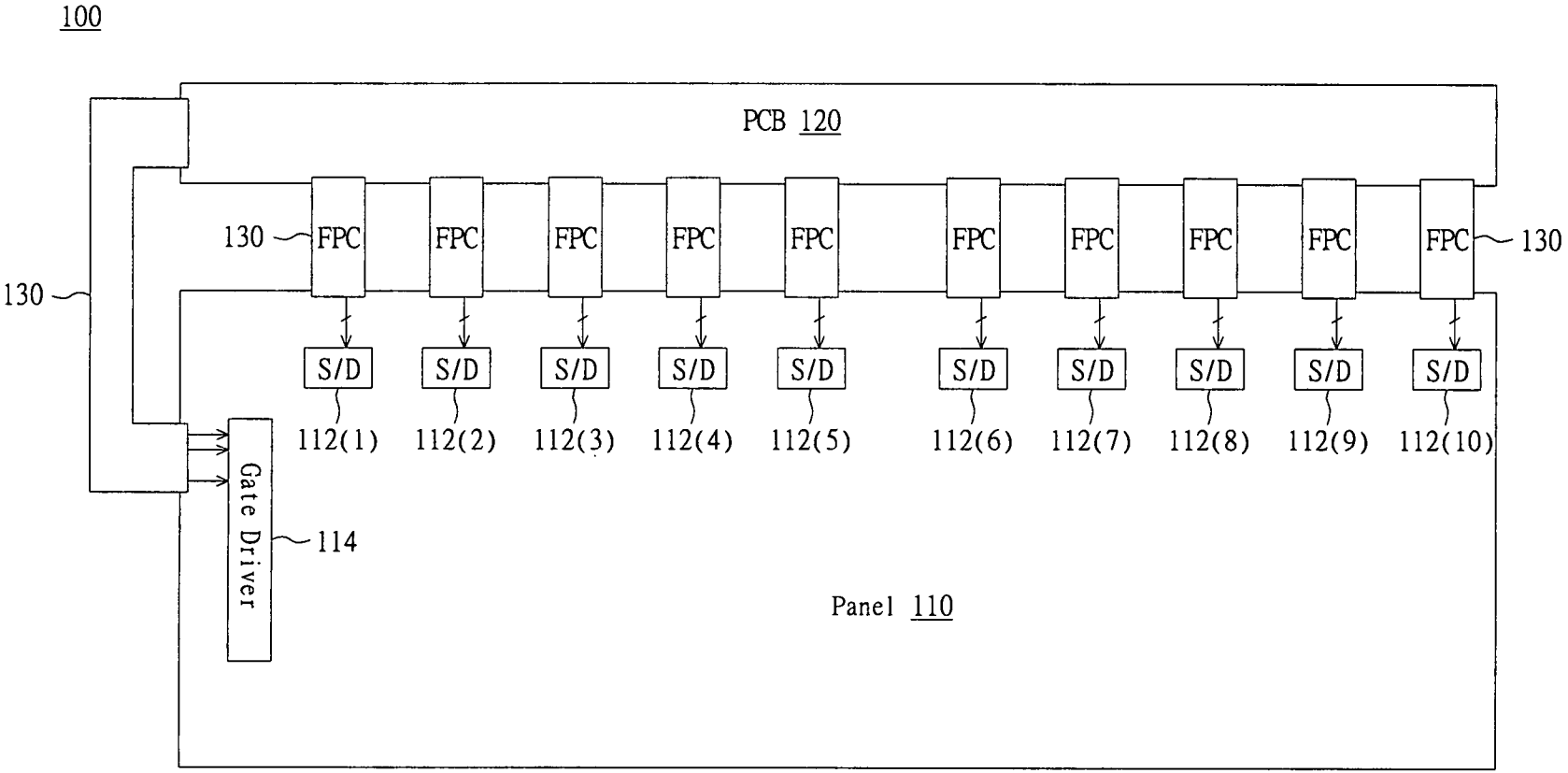
FIG. 1(PRIOR ART)
FIG. 1 is diagram of a conventional COG LCD.
Figure 2A:
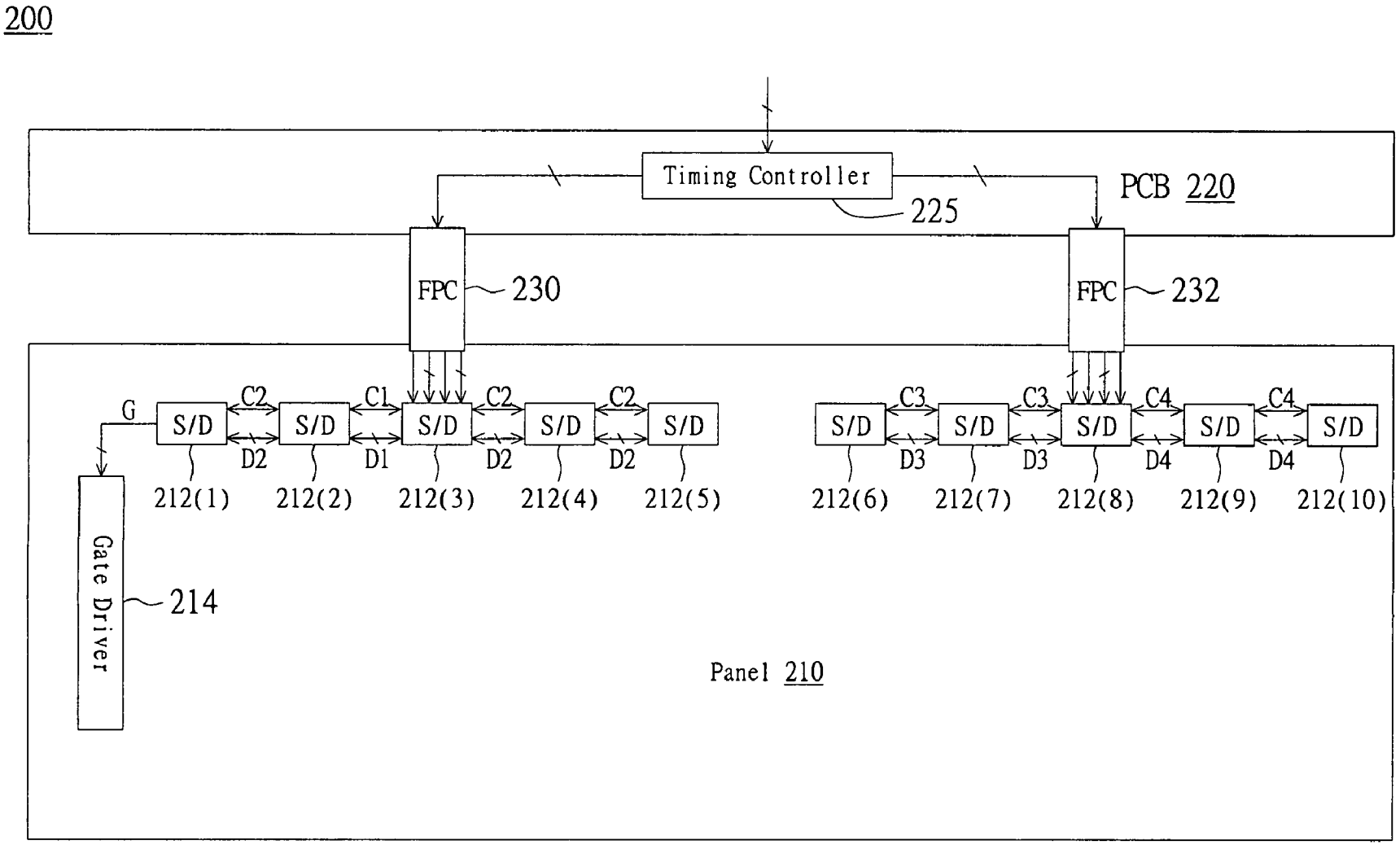
FIG. 2A is a block diagram of an exemplary chip-on-glass (COG) liquid crystal display (LCD) according to this disclosure.

FIG. 2A is a diagram of an exemplary chip-on-glass (COG) liquid crystal display (LCD) according to this disclosure. The LCD 200 includes a panel 210, a plurality of source drivers (S/D) 212(1)-212(10), at least one gate driver 214, a printed circuit board 220 and flexible printed circuit boards (FPC) 230 and 232. The source drivers 212 and gate driver 214 are disposed on the glass substrate of the panel 210 using chip-on-glass technology. The timing controller 225 is disposed on the printed circuit board 220 for outputting image data and control signals to source drivers 212(3) and 212(8), respectively, via the flexible printed circuit boards 230 and 232. Then, using wires on the glass substrate, the source driver 212(3) transmits the image data and the control signals to the neighboring source drivers 212(1), 212(2), 212(4) and 212(5), and the source driver 212(8) transmits the image data and the control signals to the neighboring source drivers 212(5), 212(6), 212(7), 212(8) and 212(10). Based on the control signals, one of the source drivers, such as the source driver 212(1), which is nearest to the gate driver 214, generates gate control signals G to the gate driver 214. Choosing the source driver nearest to the gate driver 214 reduces the length of wire coupled between the source driver and the gate driver 214, which reduces the distortions and delays of the gate control signals G caused by the wire. Any source drivers other than the source driver 212(1) can also be used to generate the gate control signals G. In this embodiment, the number of flexible printed circuit boards is reduced to two.

Each of the source drivers 212 has at least one of a first operation mode and a second operation mode. The source driver 212(3) and the source driver 212(8) are set to the first operation mode to execute a dual-way transmission. The source driver 212(3) and the source driver 212(8) each receives the image data and control signals from the timing controller 225 and transmits them to the neighboring source drivers at both the right side and the left side thereof. For example, the source driver 212(3) simultaneously transmits the image data and control signals to both the neighboring source drivers 212(2) and 212(4), which are located at the two sides of the source driver 212(3). The source drivers 212(1), 212(2), 212(4)-212(7), 212(9) and 212(10) are set to the second operation mode to execute a single-way transmission, and are not directly connected to the timing controller 225. The source drivers 212(1), 212(2), 212(4)-212(7), 212(9) and 212(10) each receives the image data and the control signals from the right (or left) source driver and transmits them to the left (or right) source driver. For instance, the source driver 212(2) receives the image data and the control signals from the source driver 212(3) on one side, and transmits them to the source driver 212(1) at the other side. In the embodiment, the LCD 200 is a big screen monitor having 10 source drivers and two flexible printed circuit board 230 and 232. The number of flexible printed circuit boards is not limited to two, as long as the distortions and delays of signals are acceptable.

In this embodiment, the source drivers are divided into a left group including source drivers 212(1)-212(5) and a right group including source drivers 212(6)-212(10). The flexible printed circuit board 230 connects to the center source drivers 212(3) of the left group, and the flexible printed circuit board 232 connects to the center source drivers 212(8) of the right group, such that the distortions and delays of signals, caused by the parasitic capacitance and resistance, are minimized. On the other hand, the source drivers can also be divided into more than three groups, and each of the groups directly connects to the timing controller via a flexible printed circuit board, so long as the distortions and delays of the signals are acceptable.

In another embodiment, the FPC 230 is connected to source driver 212(5), and FPC 232 is connected to source driver 212(6). All the source drivers are set to execute a single-way transmission. In operation, image data and control signals are conveyed to source drivers 212(5) and 212(6) via FPC 230 and FPC 232, respectively. Source Drivers 212(5) and 212(6) then provide the image data and control signals to other source drivers in the same group.

According to another embodiment, the source drivers 212 form only one driver group. The timing controller 225 is connected to a selected one of the source drivers via only one flexible printed circuit board. The selected source driver receives image data and control information from the timing controller 225 via the flexible printed circuit board, and transmits the image data and control information to other source drivers that are not directly connected to the flexible printed circuit board.

Figure 2B:
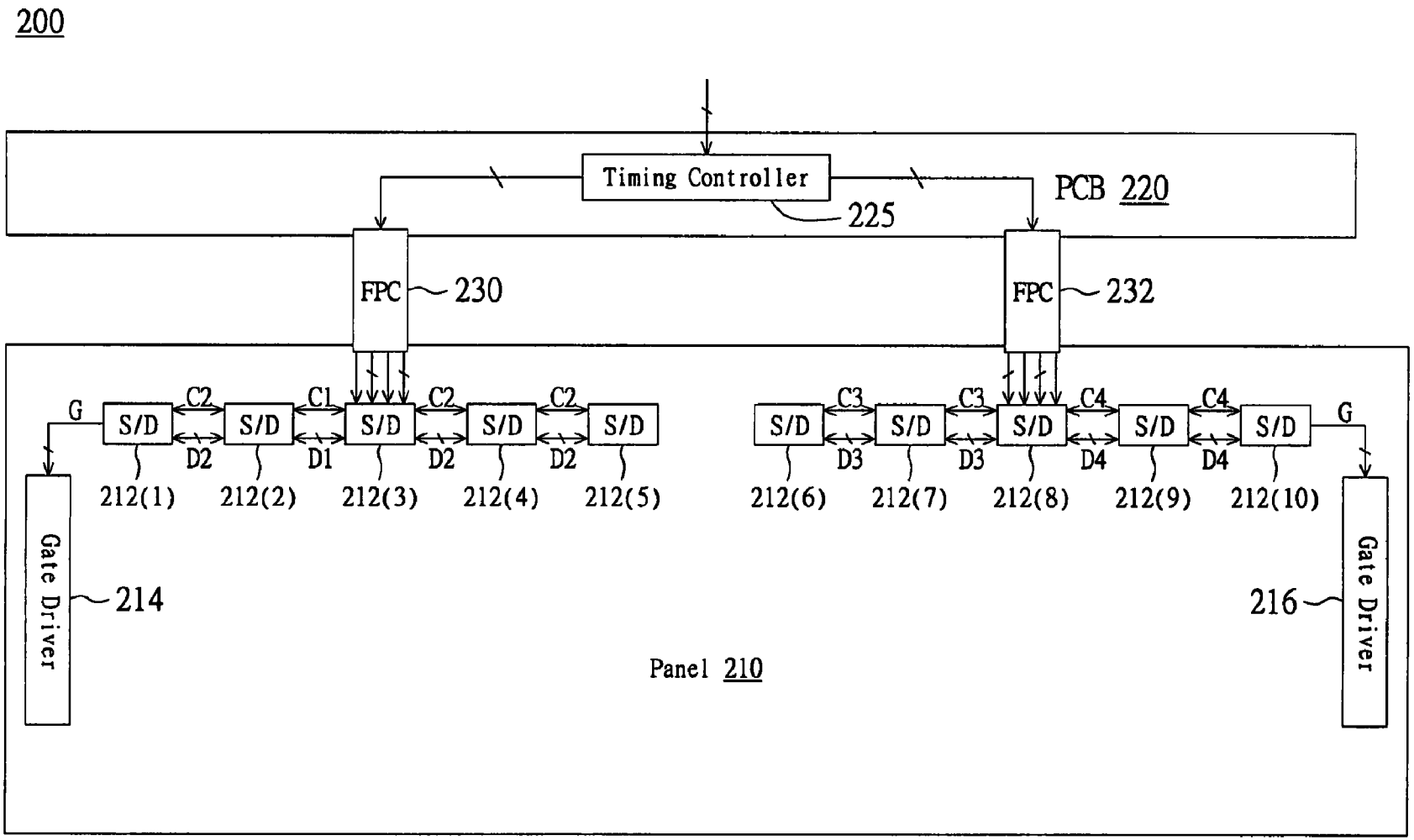
FIG. 2B is a functional block diagram of another exemplary COG LCD according to this disclosure.

FIG. 2B shows a COG LCD 250 according to still another embodiment of the disclosure. Different from the LCD 200, the LCD 250 further includes an additional gate driver 216 at the right side of the panel 210. The gate drivers 214 and 216 together drive the panel 210 from two sides. Other elements of LCD 250 are the same as those of the LCD 200 and are not described here again.

Figure 3:
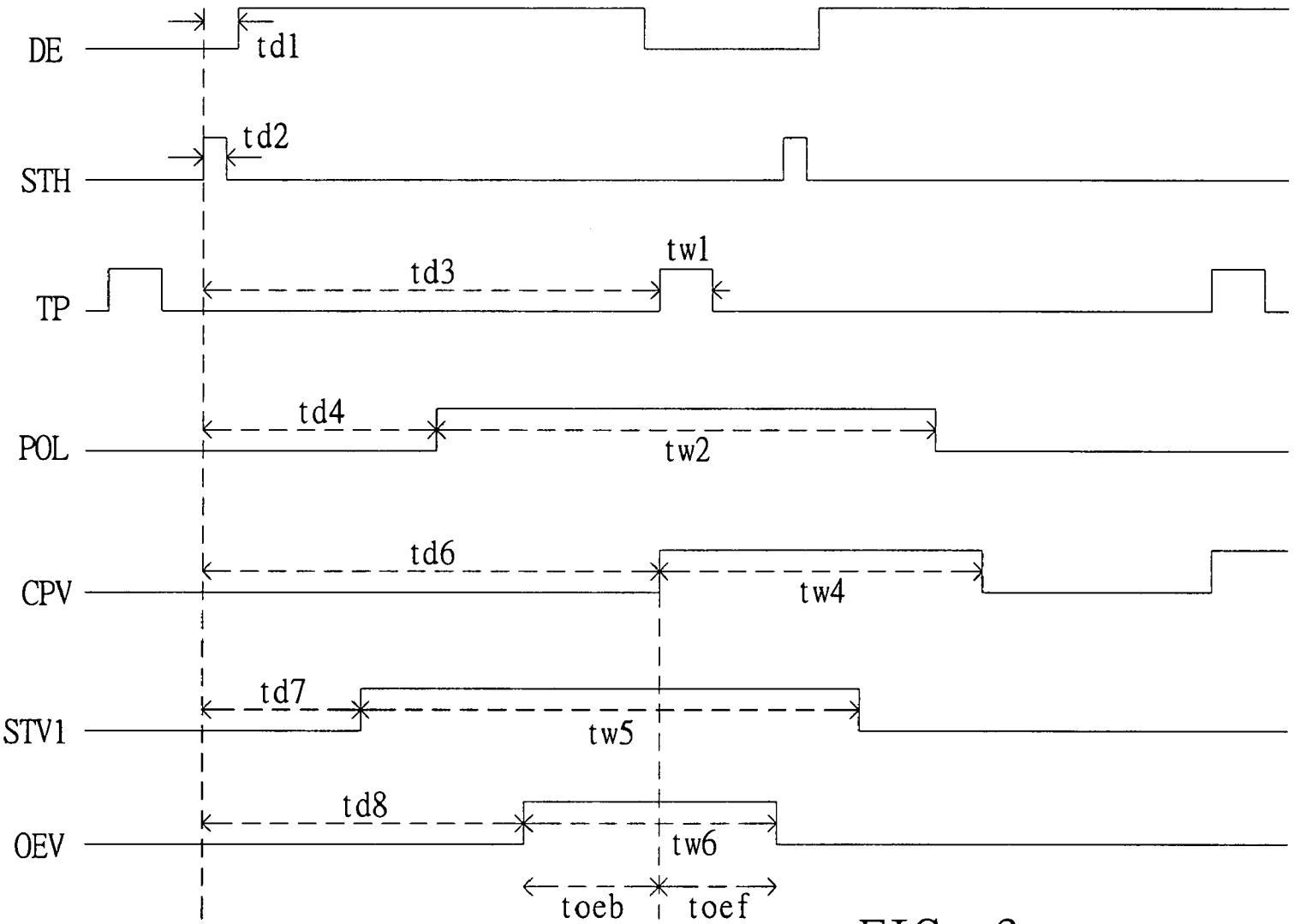
FIG. 3 shows control signals of the source drivers and the gate drivers of the LCD.

FIG. 3 is a diagram of exemplary control signals of the source drivers and the gate drivers of the LCD. The control signals include gate control signals G and source control signals S. The gate control signals G include a gate driver start signal STV for representing the start of a frame, a gate clock signal CPV for enabling a gate line, and a gate driver output enable signal OEV for defining an enabled duration of the gate line. The source control signals S includes a source driver start signal STH for notifying the source driver to start to prepare data of a horizontal line, a data enable signal DE for starting to receive data, a load signal TP for starting to output driving voltages to the data lines, and a polarization control signal POL for controlling the polarization inversion.

When the source driver start signal STH is asserted, the source drivers 212 start to prepare to receive data. After a period td1, the data enable signal DE is asserted such that the timing controller 225 starts to output the image data to the source drivers 212. The source drivers 212 generate the driving voltage based on the polarization designated by the polarization control signal POL, and then output the driving voltages to the panel 210 according to the load signal Tp.

In the conventional LCD 100, the control signals are outputted by the timing controller directly to each source driver 112 and the gate driver 114. Each control signal needs at least one wire to transmit the signals. Therefore, a plurality of wires are required. As a result of the increased number of wires, the control signals are subject to distortions and delays caused by the parasitic capacitance and resistance of the wires between the timing controller and the source drivers, and between the timing controller and the gate driver.

In the exemplary LCD 200, the timing controller 225 integrates the control signals into a control bitstream° C. and transmits it by a wire to the source drivers 212. For example, the control signals can be packed into a plurality of control packets, each representing an event relevant to a control signal. The timing controller 225 designates one of the source drivers 212 to receive the control packet by using a target identification. The target identification is, for example, included in the control packet for each source driver to identify. After receiving the control packet, the source drivers 212 decode the control packet to generate the control signal. Since only a limited number of source drivers is needed to connect to the timing controller, the number of wires required to transmit the control signals is significantly reduced.

Each of the source drivers 212 has an associated identification, such as a built-in identification code, for identifying whether a received control packet is for its own by comparing the target identification in the control packet with the built-in identification.

[Transmission Protocol of the Control Bitstream]

In an exemplary LCD of this disclosure, the timing controller 225 transmits the control bitstream C to the source driver via only one wire. The control bitstream C includes a plurality of control packets, each representing an event of a corresponding control signal, such as a pull high event or a pull low event. After receiving the control packet, the source driver 212 generates the corresponding control signal by pulling high or pulling low accordingly.

Figure 4:
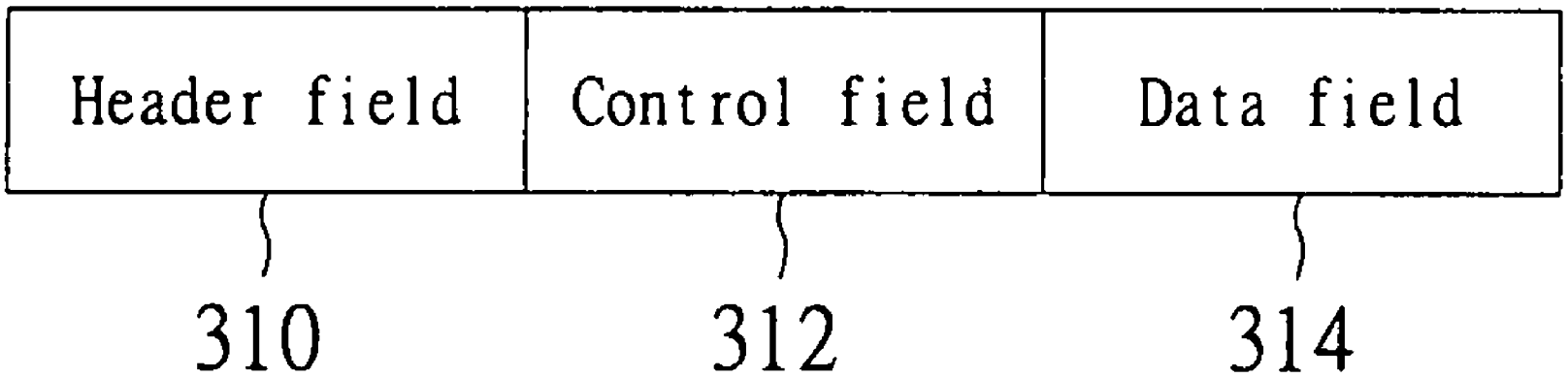
FIG. 4 is a format diagram of a control packet.

FIG. 4 is an exemplary format diagram of a control packet. A control packet includes a header field 310 and a control item, which includes a control field 312 and a data field 314. The header field 310 records a predetermined pattern for identifying the start of a packet. For example, a predetermined pattern is designated as 0x11111. The control field 312 records the type of the event, such as a STH event, a TP event, a pull high event, a pull low event and an initialization event. The data field 314 records the parameters of the event.

According to one embodiment, each control packet has 16 bits. Other numbers of data bits can be used. If the control packet is received by dual-edge sampling, it takes 8 clocks to read one control packet. In other words, the control signal generated by a pull high event and a pull low event must remain at high level for at least a duration of 8 clocks. The control signals POL, CPV, STV, OEV can each be generated by a pull high event and a pull low event. The control signals having a duration less than 8 clocks, such as control signals STH and TP, are generated by the STH event and the TP event, respectively. After receiving the STH event/TP event, the source driver pulls high the control signal STH/TP for a pre-determined period td2/tw1 and then pulls low the control signal STH/TP. The sampling method for receiving the control packet is not limited to dual-edge sampling. Other types of sampling, such as rising-edge sampling or falling-edge sampling, can also be used.

If the control packet includes a control field 312 recording the STH event, the corresponding data field 314 records the target identification. Assuming the source drivers 212(1)-212(10) have built-in identifications of 0x0001-0x1010, respectively. After receiving the control packet with a STH event, the source driver compares the target identification of the control packet with the built-in identification. Responsive to a match, the source driver pulls high the control signal STH, and then pulls low the control signal STH after a period td2.

As illustrated in FIG. 3, the control signals TP and CPV are pulled high at the same time. Accordingly, after receiving the control packet with a TP event, control signals TP and CPV are pulled high. The control signal TP is then pulled low after a period tw1, and the control signal CPV is pulled low after receiving the control packet with pull low event of CPV.

Control signals POL, STV and OEV are generated by a pull high event and a pull low event. A control packet with the control field 312 recording a pull high event, its data field 314 designates which signal is to be pulled high. A control packet with the control field 312 recording a pull low event, its data field 314 designates which signal is to be pulled low.

The control field 312 of a control pack may record an initialization event for setting several kinds of initialization, such as the fan out of the source drivers. Other kinds of events can also be represented by the control packets.

In the embodiment, only one wire is required to transmit the control bitstream C. Therefore, the number of wires connecting the timing controller and the source drivers are greatly reduced. Consequently, the layout of the circuit is simplified, and the stability is enhanced. In addition, the control bitstream C can integrate only a part of the control signals and leave other part of the control signals to be transmitted in independent wires. Although not all the control signals are integrated to the control bitstream, the number of wires is reduced.

[Source Drivers]

Figure 5A:
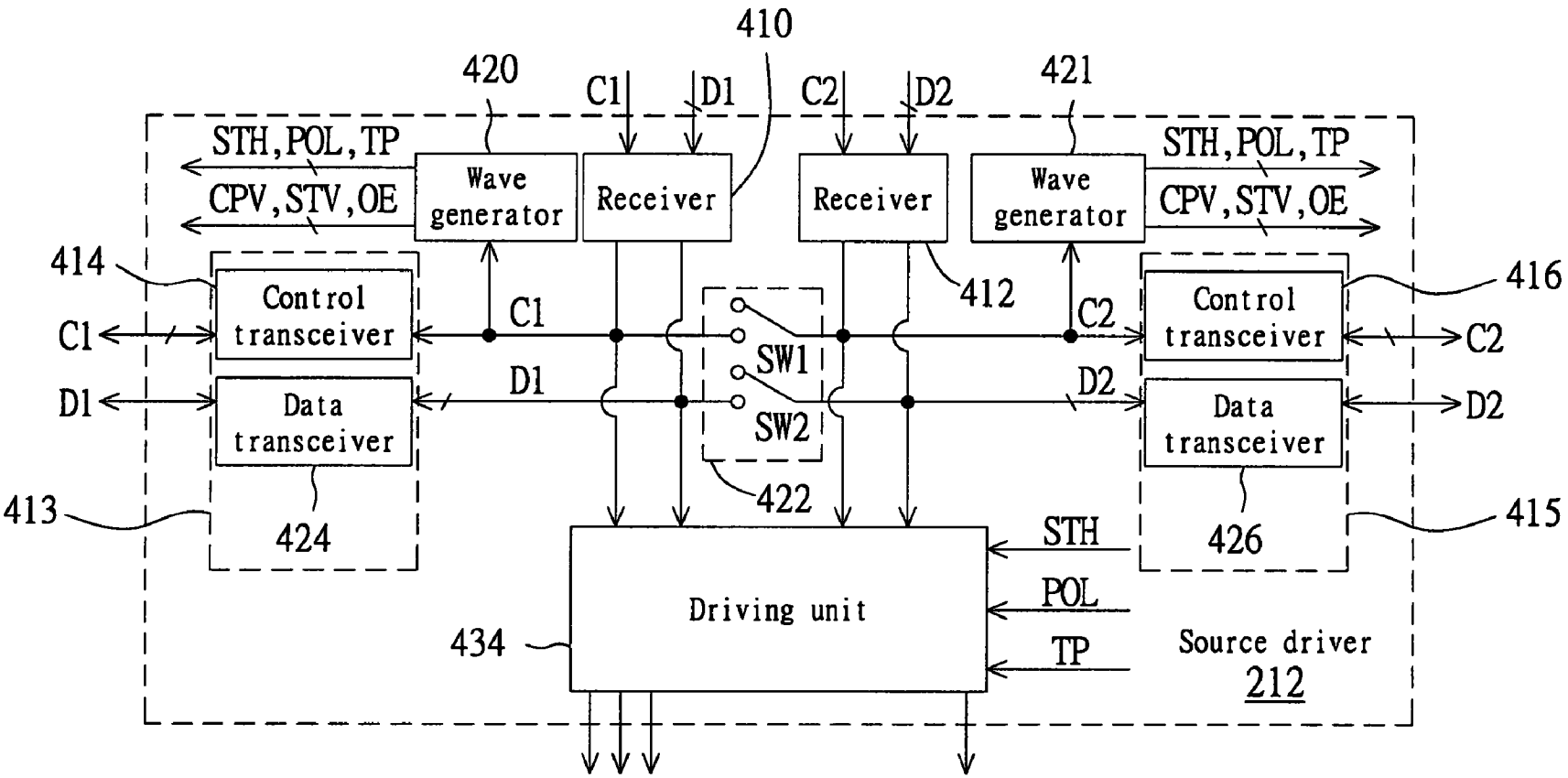
FIG. 5A is a block diagram of the source driver according to an embodiment of the disclosure.

FIG. 5A shows an exemplary source driver according to this disclosure. The source driver 212 includes receivers 410, 412, transceivers 413, 415, a bus switch 422, wave generators 420, 421, and a driving unit 434. The transceiver 413 includes a control transceiver 414 and a data transceiver 424, and the transceiver 415 includes a control transceiver 416 and a data transceiver 426.

The bus switch 422 includes two switches SW1 and SW2. When the source driver, 212(3) or 212(8), operates at the first operation mode, the bus switch turns off the switches SW1 and SW2 such that the control transceiver 414 and 416 are disconnected and the data transceiver 424 and 426 are disconnected from each other. Thus, the control bitstream C1 and the image data D1 received by the receiver 410 are transmitted to the control transceiver 414 and the data transceiver 424, respectively, and the control bitstream C2 and the image data D2 received by the receiver 410 are transmitted to the control transceiver 416 and the data transceiver 426, respectively.

When a source driver, such as 212(1)-212(2), 212(4)-212(7), 212(9), or 212(10), operates in the second operation mode, the receivers 410 and 412 are disabled, and the bus switch turns on the switches SW1 and SW2 such that the transceivers 413 and 415 are connected to each other. Consequently, the data transceivers 424 and 426 are connected and the control transceivers 414 and 416 are connected. Thus, the source driver can transmit the control bitstream and the image data received to the next adjacent source driver in response to the designated transmission direction.

The wave generators 420 and 421 receive the control bitstreams C1 and C2, respectively, for generating source control signals S, such as STH(1), STH(2), POL(1), POL(2), TP(1), TP(2), etc., and the gate control signals G, such as CPV(1), CPV(2), STV(1), STV(2), OEV(1), OEV(2), etc. The control signals G are generated by one of the source drivers. In the LCD 200 shown in FIG. 2A, one of the source drivers 212, such as 212(1), which is nearest to the gate driver 214, generates the gate control signals G, while other source drivers 212 do not. In the LCD 250 illustrated in FIG. 2B, two source drivers, such as 212(1) and 212(10), which are nearest to the gate drivers 214 and 216, respectively, generate a respective gate control signals G for the gate drivers 214 and 216, while other source drivers do not generate any gate control signals.

When receiving the signal STH, the driving unit 434 starts to latch image data D for converting to analog driving voltages in response to the signal POL, and then transmits the analog driving signals to the panel 210 after receiving the load signal TP.

When a source driver operates in the first operation mode, such as source driver 212(3), the wave generators 420 and 421 are both activated to receive the control bitstreams C1 and C2, respectively, and generate the source control signals S and the gate control signals G. The control bitstream C1 and C2 are independent, and image data D1 and D2 are independent. On the other hand, if a source driver is set to operate in the second operation mode, such as source driver 212(2) or 212(4), the control bitstream C1 is the control bitstream C2, and the image data D1 is the image data D2. Accordingly, only one of the wave generators 420 and 421 is activated to generate the source control signals S and the gate control signals G. Other wave generators in the second-operation-mode source driver can be disabled, omitted or still activated to generate the source control signals S and the gate control signals G.

Figure 5B:
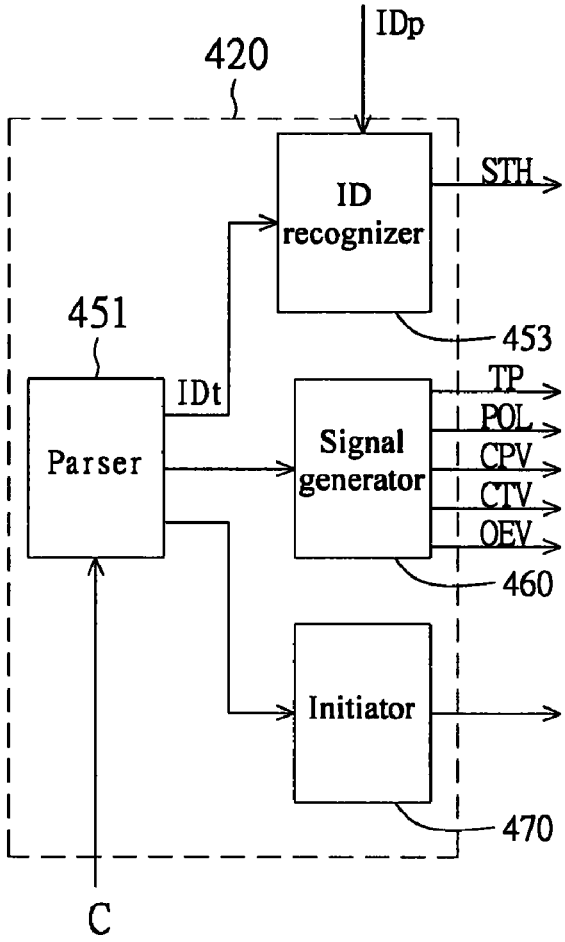
FIG. 5B is a block diagram of the wave generator in FIG. 5A.

FIG. 5B is a block diagram of the wave generator in FIG. 5A. Each of the wave generators 420 and 412 includes a parser 451, an ID recognizer 453, a signal generator 460 and an initiator 470. The parser 451 receives the control bitstream C to parse the control item, which includes the control field 312 and a data field 314, of a control packet, and sends the parsed control item to the ID recognizer 453, the signal generator 460 or the initiator 470 according to the contents of the control item: control item with an identity event, which is the STH event in this embodiment, is sent to the ID recognizer 453; control item with a pull high event or a pull low event is set to the signal generator 460; and a control item with an initialization event is sent to the initiator 470.

Figure 5C:
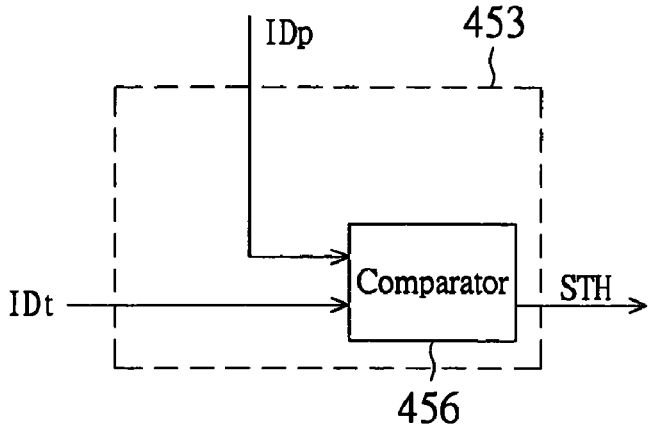
FIG. 5C is a block diagram of the ID recognizer in FIG. 5B.

FIG. 5C is a block diagram of the ID recognizer in FIG. 5B. The recognizer 453 includes a comparator 456. Each source driver has a unique chip identity IDp. The chip identity IDp is set externally, for example, by pulling high or pulling low the pins of the source driver on the glass substrate. The comparator 456 triggers the signal STH when the comparison of the chip identity IDp with a target identity IDt extracted from the control packet is matched. The duration td2 of the signal STH is preset in the comparator 456.

Figure 5D:
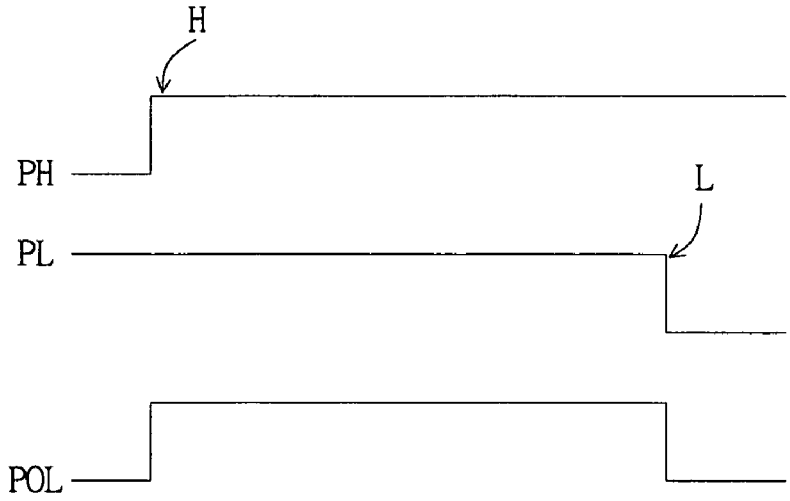
FIG. 5D is a waveform diagram of control signal POL.

The signal generator 460 pulls high the corresponding signal after receiving the control item with a pull high event. The level of the pull-high signal is maintained until the signal generator 460 receives a corresponding control item with a pull low event. FIG. 5D is a waveform diagram of control signal POL. When receiving a control item with a pull high event H, the signal generator 460 pulls high the signal PH; and when receiving a control with a corresponding pull low event L, the signal generator 460 pulls low the signal PL. Then, the coupling of the signal PH and the signal PL is the signal POL. The other control signals, such as CPV, STV, OEV, are also generated by the above-mentioned procedure.

Figure 5E:
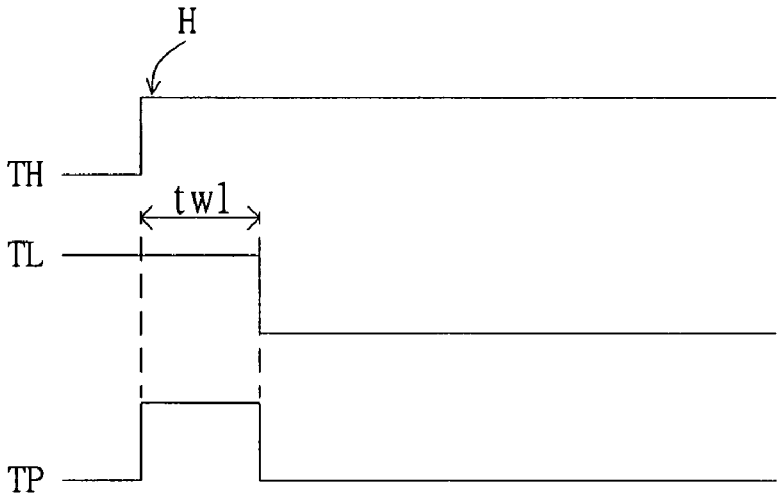
FIG. 5E is a waveform diagram of the generation of the control signal TP.

However, the control signal is not suitable to be generated by the pull high event and the pull low event if the duration time of the high level of the control signal is less than 8 clocks, such as the control signal TP, since the wave generator needs 8 clocks to read a control packet. FIG. 5E is a waveform diagram illustrating the generation of the control signal TP. When receiving the control item with a pull high event H of the control signal TP, the signal generator 460 pulls high the signal TH, then counts for a pre-determined period tw1, and then pulls low the signal TL. The coupling of the signal TH and the signal TL is the control signal TP In addition to being generated by the pull high event and the pull low event as described earlier, the gate control signals G can be generated according to the source control signals, such as STH or TP. For instance, the signal CPV may be generated according to the control signal STH. As illustrated in FIG. 3, when the control signal STH of the source driver 212(1) is asserted, the counter thereof is activated, and the signal CPV is pulled high after a period td6 has passed. After a period tw4 has passed, the signal CPV is pulled low. According to another example, the signal STV may be generated according to the control signal STH. When the control signal STH of the source driver 212(1) is asserted, the signal STV is pulled high after a period td7 and then pulled low after a period tw5. According to another example, the signal OEV is generated according to the control signal STH When the control signal STH of the source driver 212(1) is asserted, the signal OEV is pulled high after a period td8 passed and pulled low after a period tw6 passed.

After receiving the control item with the initialization event, the initiator 470 outputs a DC value to set the corresponding parameter.

An exemplary source driver of this disclosure reduces the control signal decay because the source control signal are generated by the source driver itself, not by the timing controller.

In addition, an exemplary LCD of this disclosure reduces the number of wires between the timing controller and the gate driver because the source driver generates the gate control signals and directly sends the signals to the gate driver via the wires on the glass substrate. The quality of the gate control signals are thus improved because the lengths of the transmission wires are reduced.

[Power Management]

Figure 6A:
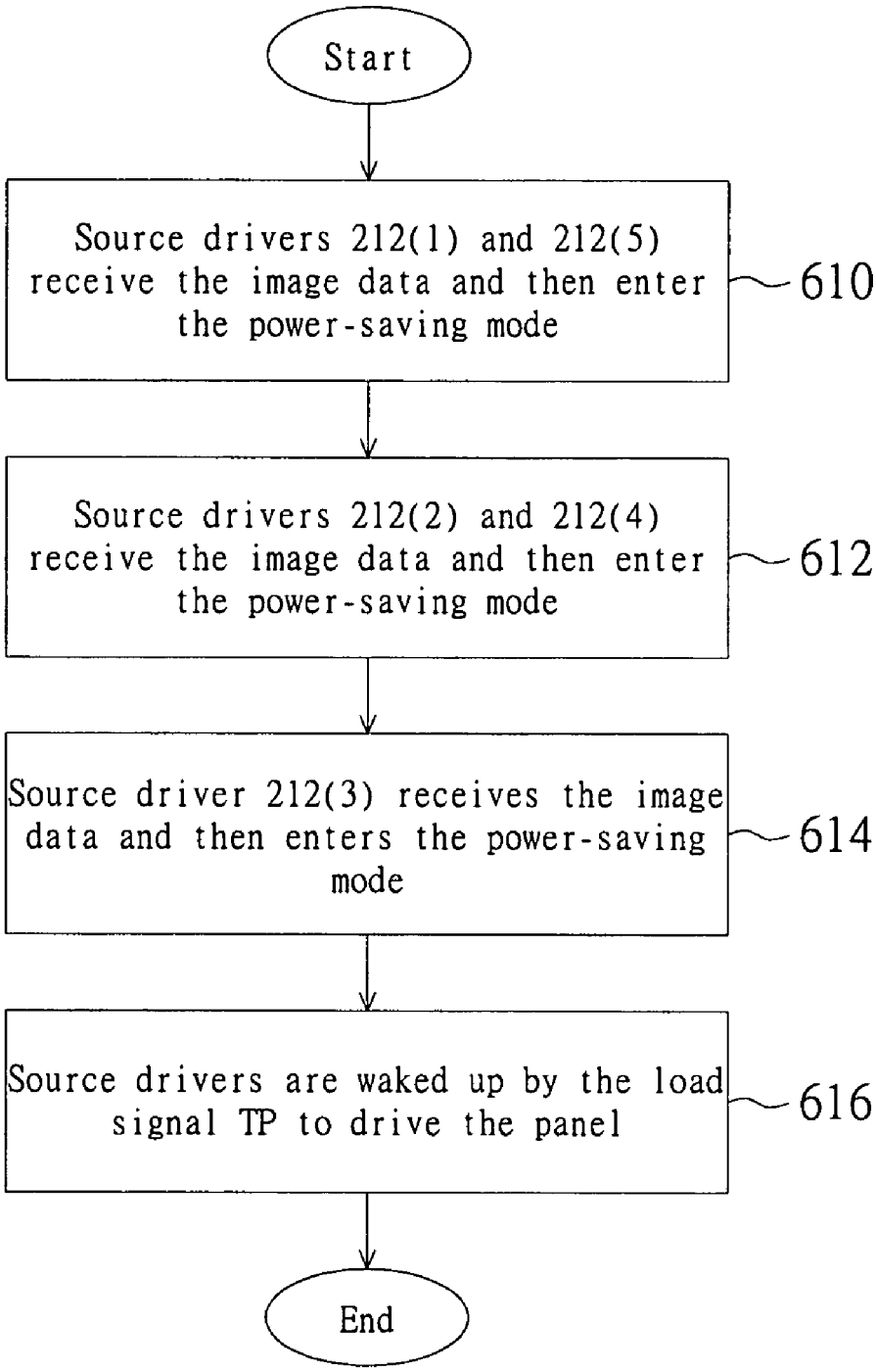
FIG. 6A is a flowchart of a convergent transmission method for power saving.

FIG. 6A is a flowchart of a convergent transmission method for power saving implemented in, for example, the source drivers 212(1)-212(5) in FIG. 2A. First, at step 610, the source drivers 212(1) and 212(5), which are farthest from the timing controller 225, receive the image data transmitted by the timing controller 225 via the source drivers, and then enter a power-saving mode. For instance, the source drivers 212(1) and 212(5) turn off the power for the data transceivers 424 and 426. Next, at step 612, the source drivers 212(2) and 212(4), which are the active ones having the farthest distances away from the timing controller 225, receive the image data and then enter the power-saving mode, such as turning off the power for the data transceivers 424 and 426 of the source drivers 212(2) and 212(4). Next, at step 614, the source driver 212(3) receives the image data from the timing controller 225 and then enters the power-saving mode. It is noted that, in the power-saving mode, the power for the control transceiver 416 and 414 of the source driver are not be turned off. Then, at step 616, each of the source drivers 212(1)-212(5) receives the load signal TP and is waked up to start to drive the panel 210. The transmission method can also apply to the source drivers 212(6)-212(10).

Figure 6B:
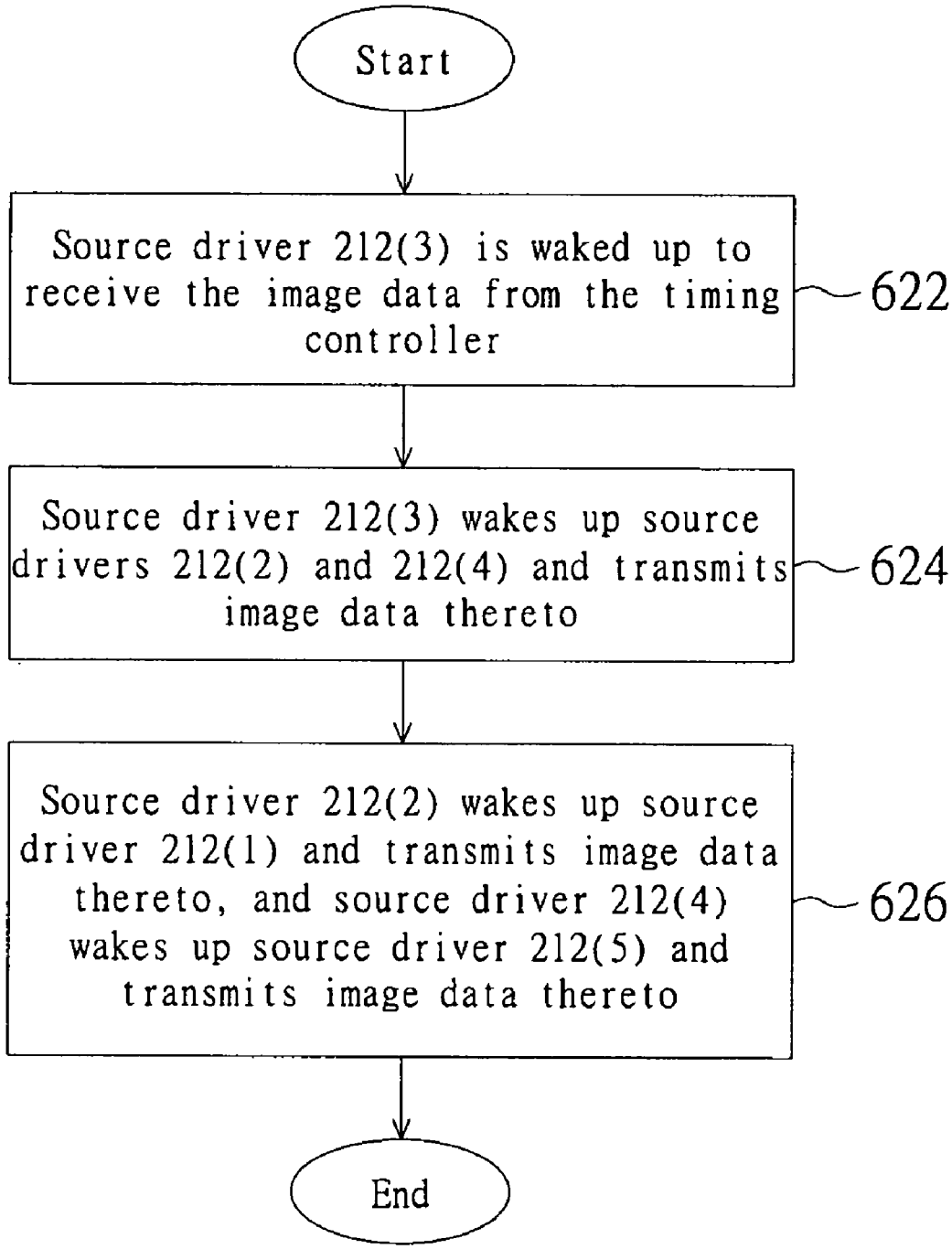
FIG. 6B is a flowchart of a divergent transmission method for power saving.

FIG. 6B is a flowchart of a divergent transmission method for power saving implemented in, for example, source drivers 212(1)-212(5) in FIG. 2A. First, the source drivers 212(1)-212(5) enter the power-saving mode. Next, at step 622, the source driver 212(3), which is nearest to the timing controller 225, is waked up to receive the image data transmitted by the timing controller 225. Next, at step 624, the source drivers 212(2) and 212(4) are waked up to receive the image data. Next, at step 626, the source drivers 212(1) and 212(5) are waked up to receive the image data. The transmission method can also apply to the source drivers 212(6)-212(10).

In the power-saving mode, at least the power for data transceivers and the driving unit can be turned off. The data transceivers transmit the image data, which has large voltage swings and high frequency that increases power consumption. Thus, the power-saving convergent/divergent transmission methods can reduce unnecessary data transmission to save power. The power for the control transceivers of the source driver should not be turned off such that the source driver can still receive the control bitstream and operate responsively.

The convergent transmission method and the divergent transmission method can be applied at the same time. For example, the source drivers 212(1)-212(3) can use the convergent transmission method, while the source drivers 212(4)-212(5) use the divergent transmission method, or vice versa. Other modifications can be implemented by the ordinary skill in the art according to the disclosure.

While the disclosure has been described by way of example and in terms of a preferred embodiment, it is to be understood that the disclosure is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A display comprising:

a glass substrate;

a plurality of serial-connected source drivers and at least one gate driver, disposed on the glass substrate; and at least one flexible connector, each of the at least one flexible connector corresponds being corresponding to a selected one of the source drivers, the selected one of the source drivers comprising a first transceiver and a second transceiver and being set to operate in a dual-way transmission mode, the first transceiver being coupled to a first neighboring source driver at a first side and the second transceiver being coupled to a second neighboring source driver at a second side;

wherein the first transceiver receives image data and control information from the corresponded flexible connector and transmits the image data and the control information to the first neighboring source driver, and the second transceiver receives the image data and the control information from the corresponded flexible connector and transmits the image data and the control information to the second neighboring source driver such that all the source drivers receive the image data and the control information.

2. The display according claim 1, wherein the at least one neighboring source driver is a single-way transmission source driver for transmitting the image data and the control information from a neighboring source driver to another neighboring source driver.

3. The display according to claim 1, wherein the at least one flexible connector is coupled to the center one of the source drivers.

4. The display of claim 1, wherein the at least one flexible connector includes at least one flexible printed circuit board.

5. The display according claim 1 being a liquid crystal display (LCD).

6. The display of claim 1, wherein the image data and the control signal are provided by a control circuit not disposed on the glass substrate, the farthest one to the nearest one of the source drivers from the control circuit sequentially receives the image data and enter a power-saving mode when the source drivers are active, and the nearest one to the farthest one of the source drivers from the control circuit is sequentially waked up to receive the image data when the source drivers enter a power-saving mode.

7. The display of claim 1, wherein the plurality of source drivers and the at least one gate driver are disposed on the glass substrate using chip-on-glass technology.

8. A source driver for driving a display, the source driver comprising:

a first receiver and a second receiver, both configured to receive image data and control information;

a first transceiver and a second transceiver, the first transceiver being coupled to a first neighboring source driver at a first side and the second transceiver being coupled to a second neighboring source driver at a second side;

a driving unit configured to generate driving voltages based on the image data and the control information to drive the display; and a bus switch configured to selectively couple the first transceiver and the second transceiver, such that:

the first transceiver and the second transceiver are disconnected when the source driver is set to operate in a dual-way transmission mode, wherein the first transceiver receives the image data and the control information from the first receiver and transmits the image data and the control information to the first neighboring source driver, and the second transceiver receives the image data and the control information form the second receiver and transmits the image data and the control information to the second neighboring source driver, and the first transceiver and the second transceiver are connected when the source driver is set to operate in a single-way transmission mode, wherein the image data and the control information received by the first transceiver are transmitted to the second transceiver.

9. The source driver according to claim 8 further comprising a first wave generator and a second wave generator for generating a source control signal and a gate control signal according to the control information.

10. The source driver according to claim 9, wherein:

the first wave generator is disabled when the source driver is set to operate in the single-way transmission mode, and the second wave generator generates the source control signal and the gate control signal.

11. The source driver according to claim 9, wherein the first receiver and the second receiver receive the control information simultaneously when the source driver is set to operate in the single-way transmission mode.

12. The source driver according to claim 8, wherein:

the first transceiver comprises a first control transceiver and a first data transceiver, and the second transceiver comprises a second control transceiver and a second data transceiver.

13. The source driver of claim 8, wherein the display is a liquid crystal display.

14. The source driver of claim 8, wherein the image data and the control information are provided by a timing controller.

15. A data transmission method in a display having a plurality of source drivers and at least one gate driver, the method comprising the steps of:

selecting at least one source driver, the selected source driver being set to operate in a dual-way transmission mode;

inputting image data and control information to a first transceiver and a second transceiver of the selected source driver, wherein the first transceiver is coupled to a first neighboring source driver at a first side and the second transceiver is coupled to a second neighboring source driver at a second side;

transmitting the image data and the control information by the first transceiver to the first neighboring source driver; and transmitting the image data and the control information by the second transceiver to the second neighboring source driver.

16. The method of claim 15, wherein the selected source driver and the neighboring source drivers are connected in series.

17. The method of claim 15, wherein the display is a liquid crystal display (LCD), the farthest one to the nearest one of the source drivers from a time controller sequentially receives the image data and enter a power-saving mode when the source drivers are active; and the nearest one to the farthest one of the source drivers from the time controller is sequentially waked up to receive the image data when the source drivers enter a power-saving mode.

18. The method of claim 15, wherein:

the display further includes a substrate; and the plurality of source drivers and the at least one gate driver are disposed on the substrate using chip-on-glass technology.

* * * * *